United States Patent [19]

Hardwicke et al.

[11] Patent Number: 4,745,715

[45] Date of Patent: May 24, 1988

[54] ELEVATED FLOOR PLATE

[75] Inventors: Carl S. Hardwicke, Grosse Pointe, Mich.; Howard R. Leffel, Jr., Maumee; George S. Spatoulas, Sylvania, both of Ohio

[73] Assignee: Farley Metals, Inc., Chicago, Ill.

[21] Appl. No.: 29,188

[22] Filed: Mar. 23, 1987

[51] Int. Cl.[4] ..... E04B 5/58

[52] U.S. Cl. ..... 52/126.6; 52/263; 52/630

[58] Field of Search ..... 52/126.6, 263, 630

[56] References Cited

U.S. PATENT DOCUMENTS

| | | | |
|---|---|---|---|
| D. 27,673 | 9/1897 | Greger . | |
| D. 193,210 | 7/1962 | Hallock | D54/2 |
| D. 270,292 | 8/1983 | Johnson | D25/91 |
| 2,615,526 | 10/1952 | Lane | 182/2 |
| 3,279,134 | 10/1966 | Donovan | 52/126 |
| 3,295,272 | 1/1967 | Kanno | 52/126 |
| 3,318,057 | 5/1967 | Norsworthy | 52/126 |
| 3,407,558 | 10/1968 | Resch | 52/573 |
| 3,616,154 | 10/1971 | Dow et al. | 161/113 |
| 3,696,578 | 10/1972 | Swensen et al. | 52/618 |
| 3,774,358 | 11/1973 | Hale | 52/81 |
| 4,035,536 | 7/1977 | Morrison | 428/118 |
| 4,397,902 | 8/1983 | Resch | 428/119 |
| 4,411,121 | 10/1983 | Blacklin et al. | 52/792 |
| 4,571,200 | 2/1986 | Serna | 52/263 |
| 4,621,468 | 11/1986 | Likozar | 52/263 |
| 4,637,181 | 1/1987 | Cohen | 52/126.5 |

OTHER PUBLICATIONS

"Mathematical Models" by H. Martyn Cundy et al. (1957) pp. 54–59.

"Space grid Structures" by John Borrego (1968) pp. 38, 42–43, 131–136, 156–157, 160–163, 194–197.

*Primary Examiner*—James L. Ridgill, Jr.

*Attorney, Agent, or Firm*—Hugh Adam Kirk

[57] ABSTRACT

The disclosure concerns a square die-cast elevated floor plate having a top continuous or perforated panel reinforced underneath by a polygonal tessellation grid of ribs. All of the ribs of the grid, including their integral ejector pin bosses and border flange, are of the same depth; however, concentric rows of polygons in the tessellation pattern have their ribs gradually increasing in thickness from the border flange to the center of the plate. The polygons in the pattern may comprise squares and octagons in which alternate sides of the octagons have a ratio of one to the square-root-of-two, and the sides of the squares correspond to the sides having the square-root-of-two length. The continuous or perforated top panel may be formed integrally or adhered to the tessellation rib pattern. The rib pattern with its integral ejector pin bosses is preferably symmetrical for at least 180° rotation of its die. The integral ejector pin bosses are preferably located along the ribs of the octagons so that they align with the ends of slotted perforations in the top panel. The thickness of the perforated floor panel may be greater than that of the continuous top panel. These plates may be supported at their adjacent corners by vertically adjustable jacks.

15 Claims, 8 Drawing Sheets

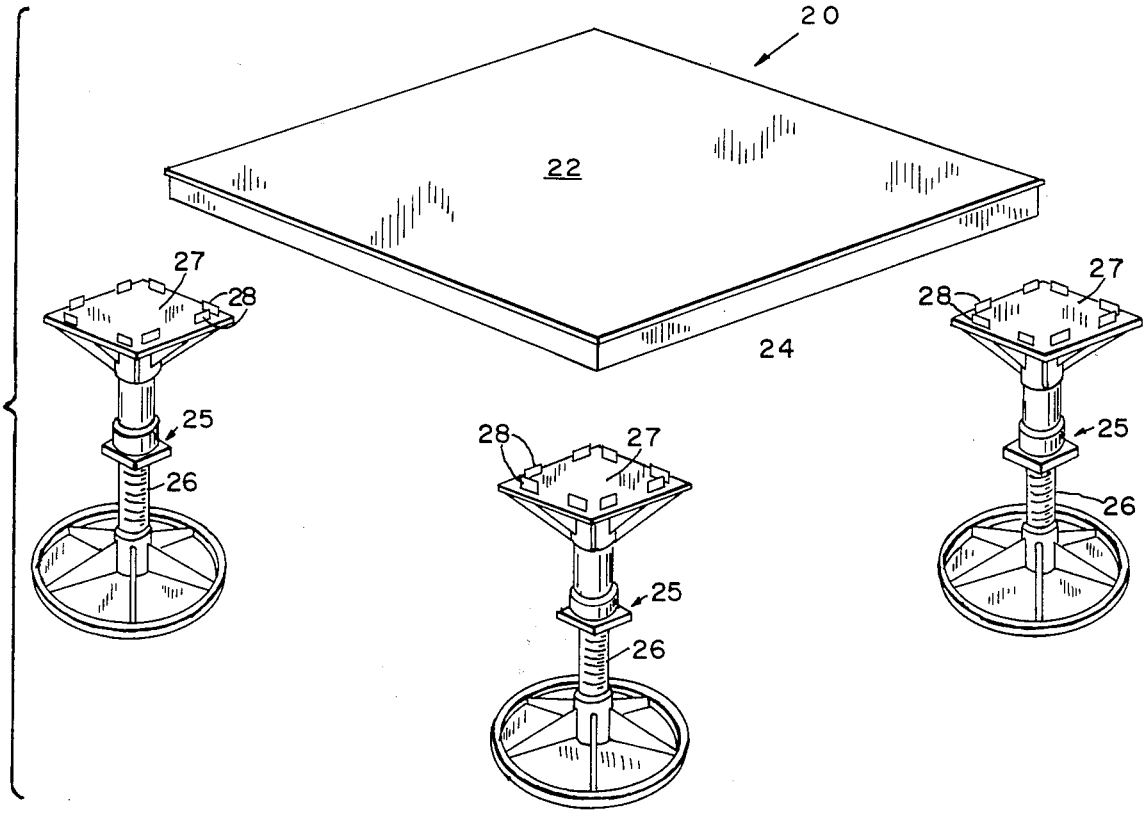
Fig I
PRIOR ART

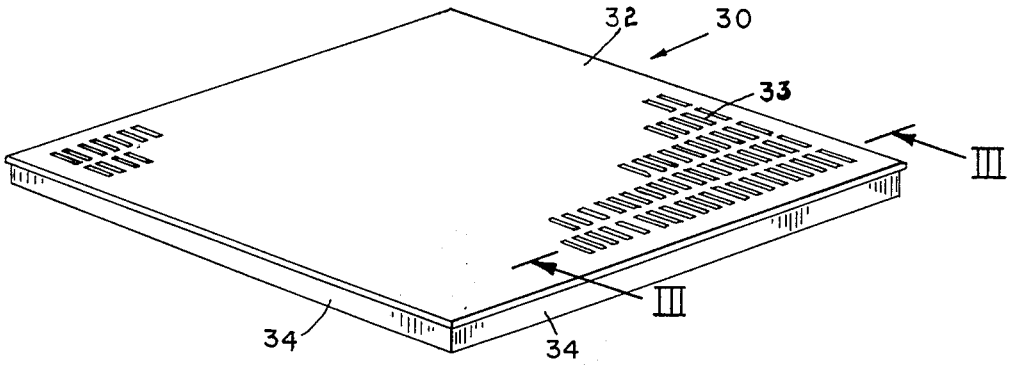
Fig II
PRIOR ART

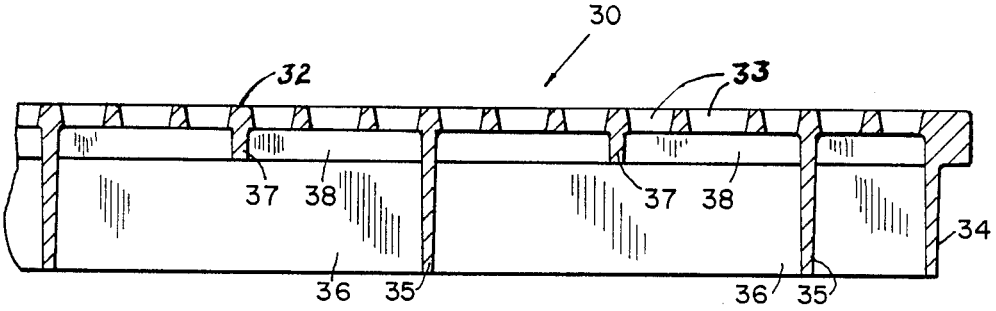
Fig III
PRIOR ART

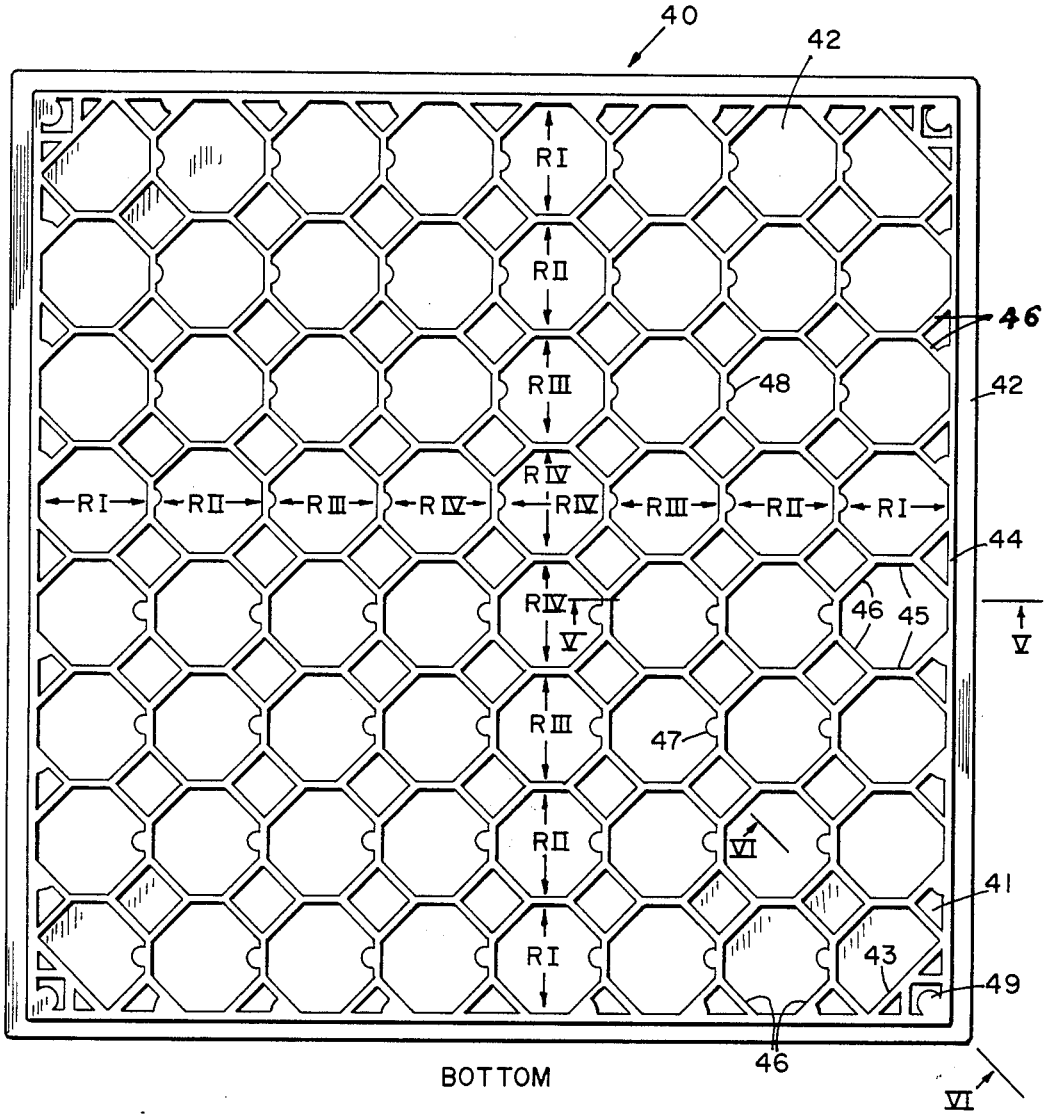
Fig IV

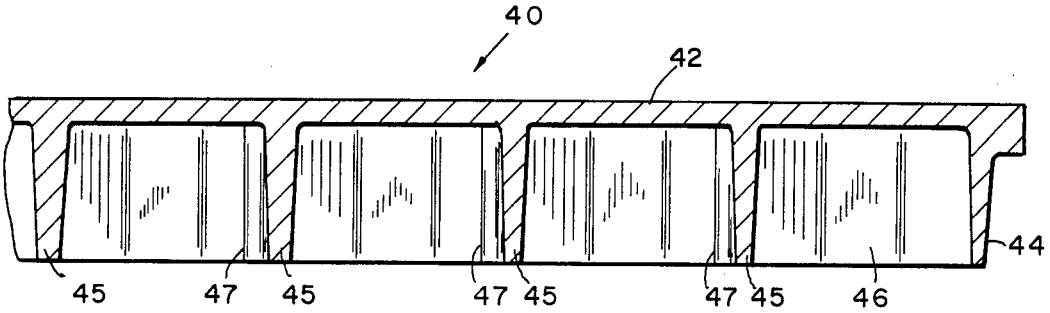
Fig V
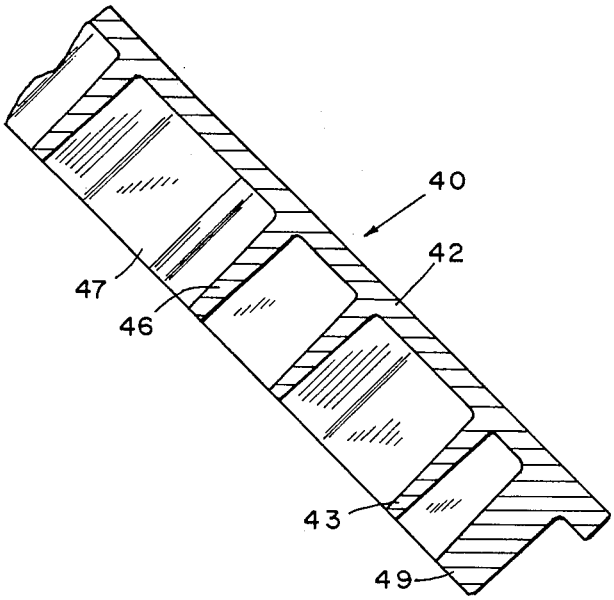
Fig V

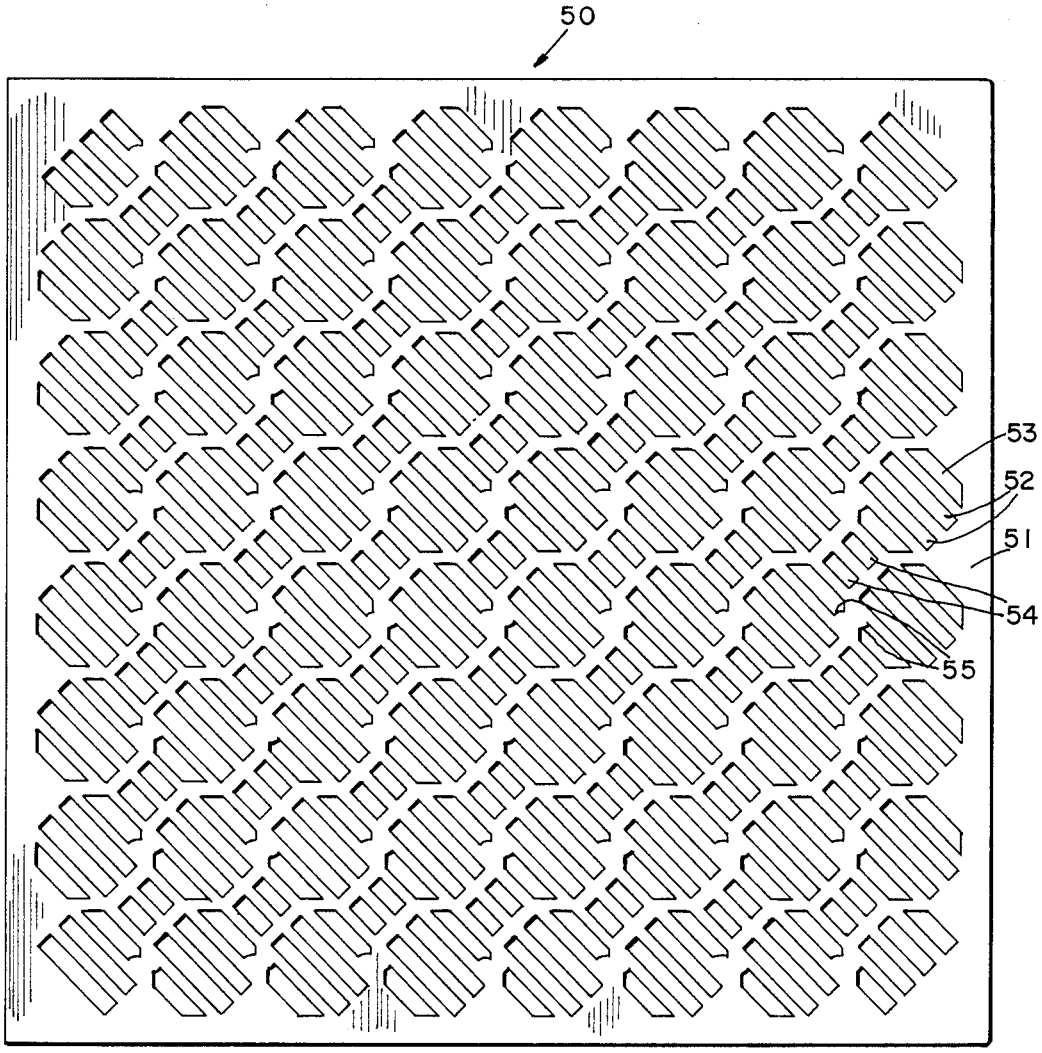
Fig VII

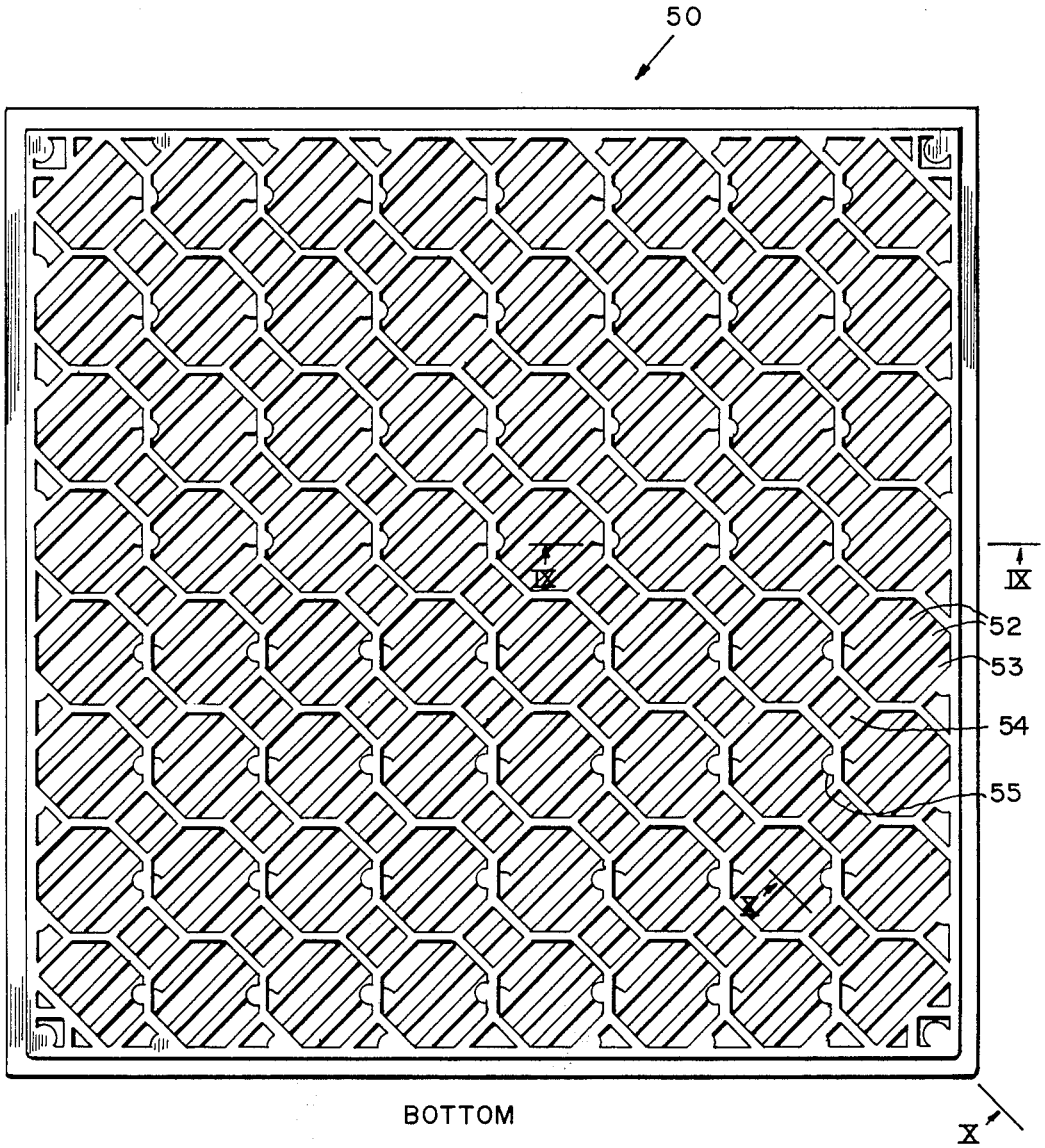
Fig VIII

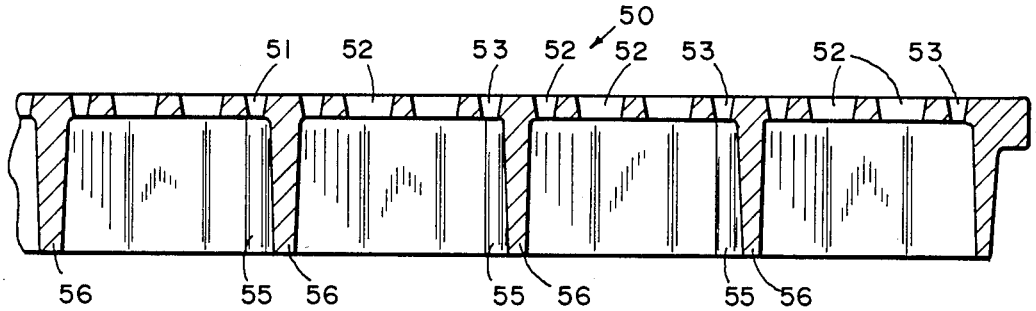
Fig IX
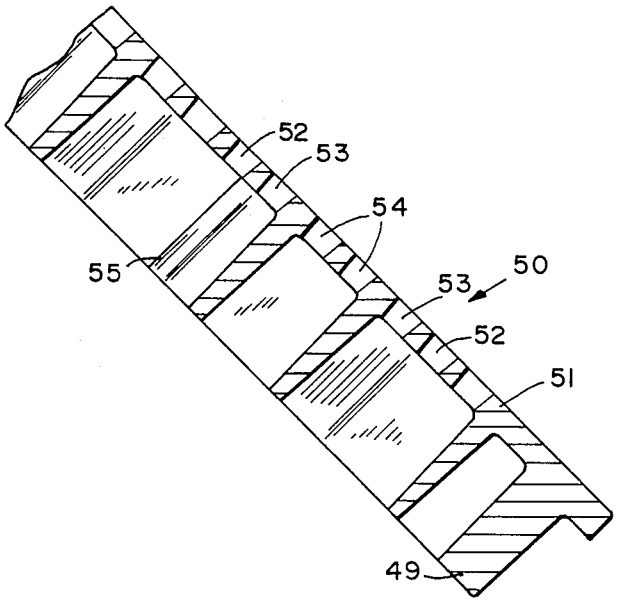
Fig X

ELEVATED FLOOR PLATE

BACKGROUND OF THE INVENTION

Previous elevated floor plates usually had rectangular rib patterns such as shown in U.S. Pat. No. 3,295,272 of Tomonobu Kanno issued Jan. 3, 1967. Also the depth of the ribs varied, and similar ribs were always of uniform thickness as they extended across the bottom of the plate. These criteria also applied to polygonal tessellation patterns, even including octagons and squares. If ejector pin bosses were incorporated in the grid, they were usually hidden at the junctions of the ribs or at the corners of the polygons in the pattern.

SUMMARY OF THE INVENTION

This invention deals with a specific structure of a polygonal tessellation pattern of ribs on the back of a panel of an elevated rectangular floor plate.

This plate is preferably square, has a uniform thickness and may have a continuous upper surface panel or a perforated upper surface panel. The perforated top panel is usually thicker than the continuous surface panel. These plates are laid together in rows and columns to cover to floor, and may be supported above the floor by a plurality of jacks located at the intersecting corners of four adjacent plates. These jacks are vertically adjustable to permit leveling of the plates and its elevated floor.

This polygonal tessellation rib pattern on the under side of the top continuous or perforated panel or surface may be molded or die-cast integrally therewith or adhered thereto, such as with a suitable adhesive or by welding. The rib pattern on each plate is surrounded by a border flange or base parallel with the edges of the top panel and inside this flange are regular concentric squares or rows of polygons. For example, one embodiment of this invention comprises octagons having alternate sides in the ratio of one to the square-root-of-two with the squares having sides equal to the square-root-of-two sides of the octagon. Also along one of the two different length sides of the octagon there is provided integrally with the rib an ejector pin boss so located that it will regularly align with the end of a slot in the perforated top panel. These slots are preferably parallel to a diagonal of the square plate. Also the arrangement of the polygons and the ejector pin bosses in the tessellation pattern are sufficiently symmetrical so that the pattern may be rotated at least 180°, and also if desired 90°, and still form a congruent grid. This symmetry enables the die for the grid part of the floor plate to be rotated into another position so as to increase the life of the die. This is because the hot metal is injected along one side of the die and that is the side where most wear of the die occurs.

One of the important features of this floor plate is that all of the ribs in the tessellation pattern, the ejector pin bosses, and the border flange are of equal and the same depth. However, the ribs in each concentric row of polygons, from the border flange to the center of the plate, gradually increase in thickness so that the thicker ribs are at the center of the plate. This increase in thickness in each row from the one adjacent the border to that at the center may be from between about 20% and 50%, and preferably about 30% to 40%.

If the floor plate are formed in a die casting machine under pressure, the top panel or grid or perforated panel is usually formed in one half of the die while the grid or tessellation pattern of ribs, border flange, and ejector pin bosses are formed in the other half of the die. In order for the parts to be easily removed or ejected from their respective dies, these ribs, flange and ejector pin bosses are tapered at least one-half degree on each side, making an included angle of at least about 1° and preferably abou 3°. However, the greater this included angle, the easier the part comes out of its die.

The continuous solid or imperforate floor plates with adjustable jacks at their corners may be used for elevated floors in computer rooms so that the cables between the units or bays of computers can be placed under these floor plates and above the normal floor upon which the jacks rest. The perforated floor plates are normally used in clean rooms in which air is circulated through the perforations of the floor to prevent the collection of dust on objects in the room. These perforated plates are preferably supported by beams aligned along the edges of the plates.

OBJECTS AND ADVANTAGES

It is an object of this invention to produce a simple, efficient, effective, economic elevated floor plate which has a relatively even load path between the edge and the center of the plate, and a lower stress deflection than previous known plates of similar weight.

Another object is to produce an elevated floor plate having a uniform depth and deflection throughout with a minimum of weight and a low internal stress when loaded.

Another object is to produce a polygonal tesselation and ejector pin boss rib pattern for an elevated floor plate, which pattern is symmetrical in at least 180° whereby the length of the die employed in high pressure die-casting for this plate has an increased life by rotation of the die so that the injected hot metal can be applied to another edge of the plate>

BRIEF DESCRIPTION OF THE DRAWINGS

The above mentioned and other features, objects and advantages, and a manner of attaining them are described more specifically below by reference to embodiments of this invention shown in the accompanying drawings; wherein FIG. I is a perspective view of an elevated floor plate according to the prior art and shown spaced above three of the four jacks which may be used in supporting the plate above a floor;

FIG. II is a perspective view of a perforated floor plate according to the prior art similar to the continuous floor plate shown in FIG. I;

FIG. III is an enlarged sectional view taken along line III—III of FIG. II showing its reinforcing ribs under its top panel having different depths and being substantially the same thickness throughout the plate;

FIG. IV is a bottom view of an elevated floor plate like that shown in FIG. I but showing its tessellation rib pattern according to one embodiment of this invention and showing the upper and lower half symmetry in the pattern of the ejector pin bosses along one side of the octagons in the pattern;

FIG. V is an enlarged sectional view taken along line V—V of FIG. IV showing the varying thickness of the ribs in the polygonal pattern, which ribs increase in thickness from the border flange to the center of the floor plate;

FIG. VI is an enlarged sectional view taken along line VI—VI diagonally of the corner of the floor plate shown in FIG. IV;

FIG. VII is a top plan view of a perforated floor plate according to an embodiment of this invention in which the perforations are slots in each polygon, and the ejector pin bosses are aligned at the ends of certain of these slots;

FIG. VIII is a bottom view of the floor plate shown in FIG. VII showing a rib pattern identical with that shown in FIG. IV;

FIG. IX is an enlarged sectional view taken along line IX—IX of FIG. VIII showing the increased thickness of the ribs in the pattern, which ribs increase in thickness from the border flange to the center of the pattern or floor plate; and FIG. X is an enlarged sectional view taken along line X—X diagonally of the corner of the floor plate shown in FIG. VIII.

DETAILED DESCRIPTION OF THE PREFERRED EMBODIMENTS

I. Prior Art

Referring first to FIGS. I through III, there are shown elevated floor plates 20 and 30 according to the prior art; plate 20 having a continuous flat top surface panel 22, and plate 30 in FIG. II having a perforated or slotted top surface panel 32. The continuous floor plate 20 is provided with a smooth square top surface panel 22 and a peripheral border flange or base rib 24 projecting downwardly around the periphery of the panel 22 and spaced slightly inwardly from the edges of the panel 22.

Also shown in FIG. I are three vertically adjustable jacks 25 employed for supporting the corners of four adjacent elevated floor plates and located under the corners of the border flange 24 of the plates 20. These jacks 25 comprise threaded central posts 26 for vertical adjustment of their upper platforms 27. These platforms 27 have upward orthogonal projections 28 at each corner for engagement behind the corners or the border or base rib flange 24 of the floor plates 20.

Referring now to the perforated floor plate 30 shown in FIG. II, its top surface panel 32 is perforated with parallel slots 33. This panel 32 of the plate 30 also has a border flange rib 34. The enlarged section taken along line III—III of FIG. II shows the slots 33 in better detail and also the arrangement of the large checker of ribs 35 and 36 which are parallel and/or orthogonal to the border or base ribs 34. Each of the squares formed by the full depth of these larger ribs 35 and 36 are divided by a lesser depth checker of ribs 37 and 38 dividing each of the larger squares into four smaller equal squares in a polygonal tessellation pattern. All of the larger parallel ribs 35 and 36 are of the same thickness, and all of the smaller parallel ribs 37 and 38 are of the same thickness.

A similar cross-section of plate 20 would be similar to that shown in FIG. III without the perforation slots 33 in its top panel 22.

II. Solid Panel Floor Plate

Referring now to FIGS. I and IV, there is shown a floor plate 40 according to this invention, in which the top and side views look the same as the prior art panel floor plate 20 in FIG. I, but the bottom tessellation polygonal pattern is different as shown in FIG. IV. This different floor plate 40 has both a continuous or solid top panel 42, a border base or rib flange 44, and a tessellation rib pattern of concentric square rows of octagons and squares, each concentric row from the border flange 44 inwardly to the center being referred to as rows RI, RII, RIII and RIV. One of the most important features of this polygonal tessellation pattern of ribs is that all of the ribs are of the same depth as the border rib or base 44, and that the thickness of the ribs in the polygons in the rows RI, RII, RIII and RIV, gradually increase in thickness as they approach the center of the plate. This increase in rib thickness may range from at least about 20% thicker to about 50% thicker at the center than the ribs in row RI of polygons. This thickness at the center unexpectedly strengthens the center of the plate so as to have substantially uniform stress when the top plate is loaded at any location throughout the whole upper surface top panel 42 area.

In this tessellation pattern of alternate octagons and squares, the ratio of the length of the sides of the octagon alternate in the ratio of one for side 45 to the square-root-of-two, or 1 to 1,414 for the sides 46, and the sides 46 of the squares equal in length to the octagon side 46 having the square-root-of-two length.

Along one side of the shorter sides 45 of each of the octagons in each row there is provided, integrally with the rib, an ejector pin boss 47 for half of the plate, and bosses 48 on the opposite side of the same ribs in the other half of the plate, so that the plate is symmetrically when it is rotated around its center 180°. The location of these bosses will be more apparent from the description below of the grid plate 50 shown in FIGS. VII through X.

As shown in FIGS. IV and VI, since the octagons do not fit neatly along the border rib flange 44, there are provided small triangles 41 in the pattern which comprise a half of one of the squares with isosceles sides 46, and at the corner of the plate 40 there is provided abou a two-thirds size octagon with a dividing rib 43, and in the corner itself an ejector pin boss 49. These latter rib 43 and ejector boss 49 are more clearly shown in the section taken diagonally of one corner of the plate 40 in FIG. IV and enlarged in FIG. VI.

III. Perforated Floor Plate

Referring now to FIGS. VII through X, there is shown a perforated or diagonally slotted plate 50, the top side of which is shown in FIG. VII having slotted top surface panel 51 composed of parallel slots 52 and 53 for each octagon and slots 54 for each square, with alternate adjacent ends of the slots 53 being provided with wider bridging areas for the ends of the ejector pin bosses 55.

The bottom view of the perforated floor plate 50 is shown in FIG. VIII, which has the same octagon and square configuration as shown in FIG. IV including the same location of the ejector pin bosses 47 and 48, but now these bosses are indicated as 55.

The section taken along lines IX—IX of FIG. VIII, similar to FIG. V, shows increasing thickness of the ribs of each concentric square row of polygons as they extend towards the center of the plate; however, the top plate has slots therein.

Another important feature of this invention is that the ribs, bosses, border flange and bars between the slots have a taper of at least about 1° included angle as shown in FIGS. V, VI, IX and X, so that the die for the ribs, bosses, and border flange and the die for the bars between the slots can easily have their parts of the plate ejected therefrom by ejection pins contacting the ends of the bosses 47, 48, 49 and 55.

IV. EXAMPLES

Comparative tests were made on solid and perforated diecast floor plates 2′ square and $1\frac{5}{8}''$ and $1\frac{3}{4}''$ in thickness, respectively. The solid panel top floor plates usually have panels about $\frac{1}{8}''$ thinner or of less depth than the perforated plates, in that a floor covering is often placed over the smooth impervious or solid surface elevated floor plates.

A prior art plate 20 according to FIG. I was compared with a plate 40 according to this invention, as shown in FIG. IV. Each plate had a 1″ square load placed in the center of one of its edges over the flange rib and in the center of the plate. Also each plate was given a dimple load by a 1″ radius roller, 1″ in axial thickness, to simulate a caster. For the floor panel of this invention, two different plate thicknesses of 0.1″ and 0.12″ were tested for their dimple load.

The results of the tests of the prior art panel are shown in Table 1 below:

TABLE I

EXISTING FLOOR PANEL ANALYSIS RESULTS

| Load Case | Load | Maximum Deflection (IN) | Maximum Equivalent Stress (PSI) |
|---|---|---|---|
| Edge Load | 1000 psi | .063 | 18,400 |
| Center Load | 1000 psi | .052 | 15,000 |
| Dimple Load | 1000 psi | .11 | 26,700 |

The results of similar tests on a plate of the same dimensions and weight but with a structure according to this invention as shown in FIG. IV, are shown in Table II below:

TABLE II

HONEYCOMB FLOOR PANEL ANALYSIS RESULTS

| Load Case | Load | Maximum Deflection (IN) | Maximum Equivalent Stress (PSI) |
|---|---|---|---|
| Edge Load | 1300 psi | .028 | 21,600 |
| Center Load | 1300 psi | .025 | 19,800 |
| Dimple Load | | | |
| a. .1″ plate | 1000 lbs. | .058 | 27,000 |
| b. .12″ plate | 1000 lbs. | .042 | 21,300 |

V. Conclusion

Although a specific octagon and square regular tessellation pattern for the ribs is described above, it should be understood that other polygonal tessellation patterns may be employed without departing from the scope of this invention, provided that these other patterns have at least dual symmetry as to the location of their ejector pin bosses integrally formed with the ribs of the pattern, and most importantly, that the thickness of the ribs gradually increases at least 20% from the concentric squares of polygons from the border flange to the center of the floor plate. Furthermore, it is to be understood that these plates may be made out of other materials than the die-cast aluminum and/or that the top plate on the tessellation pattern may be formed separately from the tessellation pattern of ribs and then glued or welded together instead of being integrally cast as a unit. Still further, it should be understood that the thickness of the top panel, whether perforated or not, may vary; however, the perforated panel usually is thicker than that of the continuous or solid surface panel plate.

While there is described above the principles of this invention in connection with specific apparatus, it is to be clearly understood that this description is made only by way of example and not as a limitation to the scope of this invention.

We claim:

1. A rectangular elevated floor plate comprising:

(A) a top panel, (B) a polygonal tessellation pattern of concentric rows of ribs attached and orthogonally projecting from said panel, (C) a base rib attached and orthogonally projecting from along the edges of said panel, (D) a plurality of ejector pin bosses integrally attached to one of the sides of at least some of the polygons in said tessellation pattern;

all of said ribs and bosses being of the same depth projecting orthogonally the same distance from the same side of said panel, and the thickness of said ribs in each said row inwardly from said base ribs to the center of said plate being thicker with the thickest ribs being at the center of said plate.

2. A floor plate according to claim 1 wherein said rectangular plate is square.

3. A floor plate according to claim 1 wherein said panel is uniform and solid.

4. A floor plate according to claim 1 wherein said tessellation pattern of ribs and said top panel are integral.

5. A floor plate according to claim 1 wherein the symmetry of said ejector pin bosses is at least 180° in the plate.

6. A floor plate according to claim 1 including adjustable vertical supports for each corner of said plate.

7. A floor plate according to claim 1 wherein said polygons are alternate octagons and squares.

8. A floor plate according to claim 7 wherein alternate sides of said octagons have ratio of lengths of one to the square-root-of-two, and said squares have sides equal to the length of said octagon sides of the square-root-of-two.

9. A floor plate according to claim 1 wherein the sides of said ribs and bosses all have an included angle taper away from their bases in said panel of at least 1°.

10. A floor plate according to claim 9 wherein said taper has an included angle of about 3°.

11. A floor plate according to claim 1 wherein said thickness of said ribs in the said rows inwardly from said base ribs increase in equal steps up from about 20% to about 50% thicker at the center of said plate.

12. A floor plate according to claim 11 wherein the increase in thickness of said ribs is about 30%.

13. A floor plate according to claim 1 wherein said panel is perforated.

14. A floor plate according to claim 13 wherein the perforations in said panel are slots.

15. A floor plate according to claim 14 wherein said slotted plate is thicker than a uniform solid plate.

* * * * *